US006273545B1

(12) United States Patent
Oide

(10) Patent No.: US 6,273,545 B1
(45) **Date of Patent: *Aug. 14, 2001**

(54) INK-JET RECORDING DEVICE THAT REUSES WASTE INK AS PROCESS BLACK INK

(75) Inventor: Katsuhisa Oide, Ebina (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/204,349

(22) Filed: Dec. 4, 1998

(30) Foreign Application Priority Data

Dec. 15, 1997 (JP) ..... 9-345011

(51) Int. Cl.[7] ..... B41J 2/165
(52) U.S. Cl. ..... 347/24; 347/30
(58) Field of Search ..... 347/22, 24, 30, 347/29, 36

(56) References Cited

U.S. PATENT DOCUMENTS 4,337,468 * 6/1982 Mizuno ..... 347/75
4,847,637 * 7/1989 Watanabe et al. ..... 347/30
5,412,411 * 5/1995 Anderson ..... 347/28
5,835,109 * 5/1995 Uchida ..... 347/24

FOREIGN PATENT DOCUMENTS

A-364960 12/1992 (JP) .
A-9-58013 3/1997 (JP) .
A-10-211718 8/1998 (JP) .
10-272149 * 10/2000 (JP) .

OTHER PUBLICATIONS

E.T. Osborne et al. "Color balanced Ink Jet System", IBM Technical Disclosure Bulletin, p.1313, Oct. 1975.*
Ichihasi, Hiroo et al., "Ink Delivery System for BJ Full–Line Head,"Canon Aptex, Inc., 1997, pp. 149–152.

* cited by examiner

*Primary Examiner*—Judy Nguyen
(74) *Attorney, Agent, or Firm*—Oliff & Berridge, PLC

(57) ABSTRACT

To provide an ink-jet recording device in which ink sucked in maintenance is utilized again and an ink absorber for waste ink is not required, process black ink obtained by mixing ink in each color of cyan, magenta and yellow is used for black ink. In a maintenance part, a cap is attached to each recording head, and dust, bubbles and others in the recording head are removed together with ink by sucking by a pump. Process black ink is processed by mixing ink sucked at this time. Dust and bubbles in the ink are removed by a filter and after the concentration of the ink is adjusted by a diluent adder, the ink is supplied to a recording head for black ink through a black ink filling path and utilized there again. In this process, no waste ink is produced and an ink absorber for waste ink is not required.

6 Claims, 3 Drawing Sheets

INK-JET RECORDING DEVICE THAT REUSES WASTE INK AS PROCESS BLACK INK

BACKGROUND OF THE INVENTION

The present invention relates to an ink-jet recording device for recording by jetting ink.

An ink-jet recording device supplies ink stored in an ink tank to an ink-jet recording head, pushes out and jets ink by predetermined quantity from a nozzle via a narrow passage formed in the ink-jet recording head, adheres it to a recording medium records and records. Fine dust, bubbles and others are mixed in ink supplied from an ink tank. Bubbles and dust also invade into the passage of ink by the replacement of ink tanks and others. Normally they are filtered by a filter and others, however, nevertheless, there is a case that dust and bubbles invade into an ink-jet recording head, bubbles greatly grow, they block a narrow passage and ink cannot be jetted. When a passage is blocked as described above, the phenomenon emerges as the defect of the quality of an image.

To maintain the quality of a recorded image, maintenance for removing dust and bubbles which invade into an ink-jet recording head as described above is essential. In maintenance, large quantity of ink is sucked by a pump and others from the side of a nozzle of an ink-jet recording head so as to exhaust dust and bubbles left inside together with the ink outside through a nozzle. The sucked ink is carried to an ink absorber, is impregnated and held. For the ink absorber, the one with large capacity is built in the body of a recording device to reduce the labor of replacement. Therefore, there is a problem that the recording device is large-sized. There is also a problem that maintenance in which ink is sucked is frequently executed and if the quantity of absorbed ink exceeds the capacity of an ink absorber, work for replacing ink absorbers is required. Further, as the absorbed ink is not utilized again and discarded as waste ink, there is a problem that the frequency of the replacement of ink tanks for black ink which is particularly high in the frequency of utilization is high and the running cost is high. To miniaturize the above ink absorber for waste ink and facilitate work for replacement, a method of being provided with an ink absorber to a head cartridge in addition to an ink tank is devised as a method disclosed in the Unexamined Japanese Patent Application Publication No. Hei 4-364960 for example. According to the above constitution, ink absorbers can be also replaced by work for replacing ink cartridges when ink in an ink tank is short and the work is facilitated. However, an ink absorber for waste ink still exists and a head cartridge is large-sized because volume for the ink absorber is required.

For a large-sized ink-jet recording device, there is also a method in which waste ink is not produced by sucking every color of ink used for recording and returning the sucked ink to an ink tank. However, according to the method, as a sucking mechanism and a mechanism for returning the sucked ink to an ink tank are required to be provided every color, there is a defect that the whole device becomes large-sized.

SUMMARY OF THE INVENTION

The present invention is made in view of the above situation and the object is to provide an ink-jet recording device in which for example, ink sucked in maintenance is utilized again without producing waste ink and an ink absorber for waste ink is not required.

In the present invention, black ink processed by mixing ink in cyan, magenta and yellow desirably by the same quantity 1is used for black ink. When maintenance operation is executed in an ink-jet recording head using three colors of cyan, magenta and yellow and ink in three colors is sucked, the sucked ink in the three colors is mixed to be process black. Heretofore, as ink using black dye is used for black ink, process black ink obtained by mixing ink in three colors is discarded without using the ink for black ink. However, according to the present invention, as process black is used for black ink, process black obtained by mixing sucked ink in three colors can be utilized again.

As the sucked ink is originally ink sucked for maintenance, dust and bubbles may invade. When the sucked ink is used as it is, dust and bubbles are returned into an ink passage and the defect of the quality of an image may be caused. Therefore, it is desirable that a filter for removing dust and bubbles is provided to a path to the ink tank of black ink. If ink is sucked for maintenance, ink the viscosity of which is increased in a nozzle because of drying may be sucked. Also, to correspond to ink the viscosity of which is increased, diluent adding means for adding diluent to adjust the viscosity of ink may be also provided to a path to the ink tank of black ink.

DESCRIPTION OF THE PREFERRED EMBODIMENTS

Figure 1:
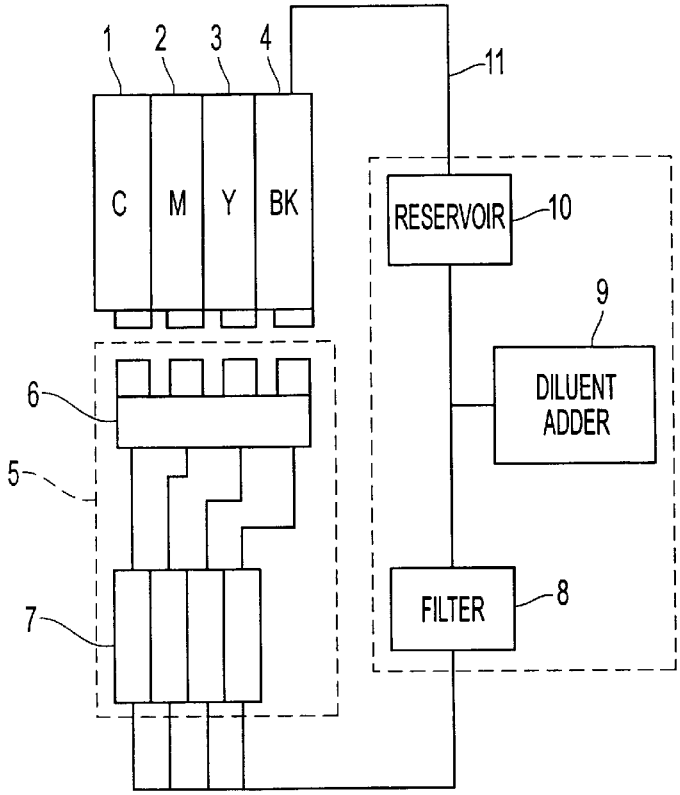
FIG. 1 is a schematic main block diagram showing a first embodiment of an ink-jet recording device according to the present invention.

FIG. 1 is a schematic main block diagram showing a first embodiment of an ink-jet recording device according to the present invention. As shown in FIG. 1, a reference number 1 denotes a recording head for cyan ink, 2 denotes a recording head for magenta ink, 3 denotes a recording head for yellow ink, 4 denotes a recording head for black ink, 5 denotes a maintenance part, 6 denotes a cap, 7 denotes a pump, 8 denotes a filter, 9 denotes a diluent adder, 10 denotes a reservoir and 11 denotes a black ink filling path.

The recording head for cyan ink 1, the recording head for magenta ink 2 and the recording head for yellow ink 3 respectively jet ink in cyan, magenta and yellow from a nozzle according to the image information of each color. The recording head for black ink 4 uses process black obtained by mixing ink in three colors of cyan, magenta and yellow by the same quantity for black ink and jets process black ink from a nozzle according to the image information of black. Each recording head shall be a thermal type recording head which heats ink by a heater driven according to image information, generates bubbles in ink by the heat and jets ink by pressure when bubbles grow. In normal recording, these recording heads respectively record by adhering jetted ink in each color to a recording medium opposite to the recording medium.

The maintenance part 5 is provided to execute various maintenance operation of each recording head. Maintenance operation is mainly executed to remove ink the viscosity of which is increased by drying in a recording head, dust and bubbles. For maintenance operation, false jetting in which ink jetting operation is executed as in recording for example, sucking operation in which ink is forcedly sucked, wiping operation in which a nozzle face is wiped by a wiper not shown and others are executed. The cap 6 is provided to the maintenance part 5 and each recording head is covered with the cap 6 when recording operation is not executed so as to prevent a nozzle through which ink is jetted from being dried.

The pump 7 sucks ink and can suck ink from each recording head by attaching the cap 6 to each recording head and sucking. Hereby, dust and bubbles respectively left in each recording head or ink the viscosity of which is increased in a nozzle and others can be exhausted out of the recording head. If false jetting is executed, the cap 6 receives jetted ink and the pump 7 can collect ink the cap 6. FIG. 1 shows that the pump is provided every recording head, however, the present invention is not limited to this and one pump also may suck ink in all the recording heads.

Ink in cyan, magenta, yellow and process black respectively collected by the pump 7 is mixed. As maintenance operation such as sucking operation and false jetting is executed approximately equally for each recording head, the quantity of collected ink in each color is also approximately equal. Therefore, collected and mixed ink becomes process black ink. Collected and mixed ink is filled into a black ink tank provided to the recording head for black ink 1 through the black ink filling path 11. As the black ink is originally process black ink obtained by mixing ink in three colors of cyan, magenta and yellow, the composition of ink and the result of printing are not influenced even if the black ink tank is filled with collected and mixed ink.

In the present invention, as collected ink is not impregnated in an ink absorber as in a conventional type, such an ink absorber for waste ink required in the conventional type is not required and a recording device can be miniaturized. Work such as the replacement of ink absorbers is not required. Further, as ink discarded in a conventional type is utilized again, the running cost can be reduced and labor required for replacing recording heads or ink tanks can be reduced. Particularly, as black ink high in the frequency of utilization is filled again, the above effect is further enhanced.

The filter 8, the diluent adder 9, the reservoir 10 and others can be provided to the black ink filling path 11. As described above, as one object of maintenance operation is to remove dust, bubbles and others, it is conceivable that dust, bubbles and others are mixed in collected ink. The filter 8 removes such dust, bubbles and others in ink.

Ink the viscosity of which is increased by drying as described above is also sucked. Ink the viscosity of which is increased has an effect upon the characteristic of jetting and others. Therefore, the diluent adder 9 adds diluent to collected and mixed ink and returns to the recording head for black ink 4 after the viscosity of ink is adjusted. Hereby, a problem such as plugging in the recording head for black ink 4 is prevented and the quality of images recorded by the recording head for black ink 4 can be maintained.

The reservoir 10 can store process black ink to be filled into the recording head for black ink 4. When process black ink collected with the black ink tank of the recording head for black ink 4 full is filled, the black ink tank may overflow. The reservoir 10 stores collected and mixed process black ink and can prevent the black ink tank from overflowing because of the filling of ink.

It may be judged when the recording device is designed whether the filter 8, the diluent adder 9, the reservoir 10 and others are provided to the black ink filling path 11 or not and they may be also selectively used or the black ink filling path may be also constituted without installing these.

Figure 2:
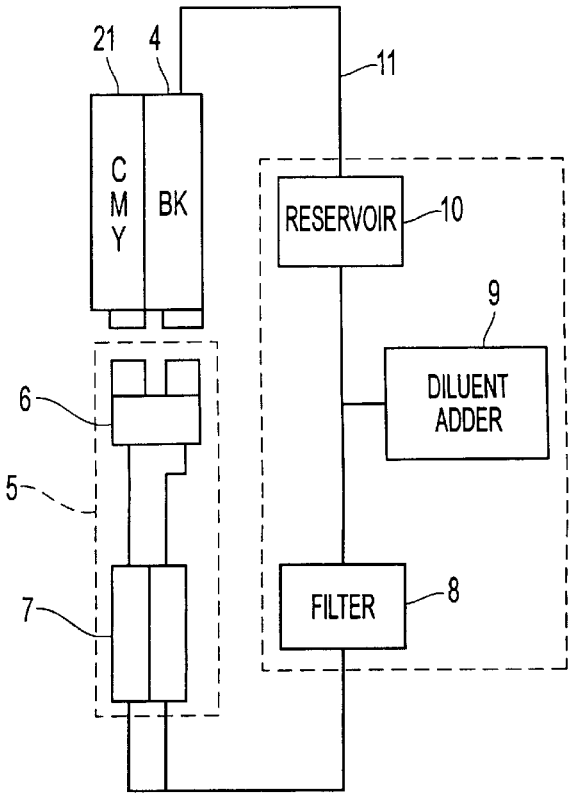
FIG. 2 is a schematic main block diagram showing a second embodiment of the ink-jet recording device according to the present invention.
Figure 3:
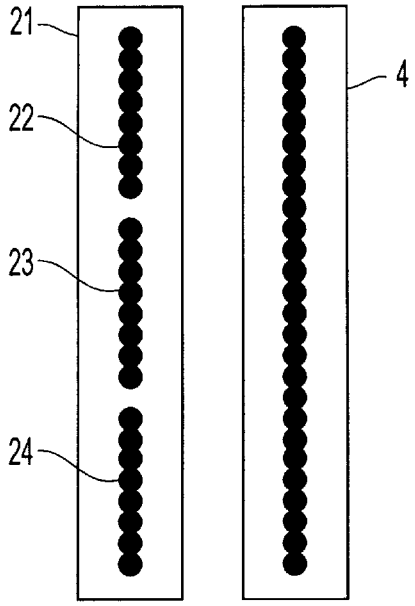
FIG. 3 is a plan showing a nozzle face in one example of a color recording head used in the second embodiment of the ink-jet recording device according to the present invention.

FIG. 2 is a schematic main block diagram showing a second embodiment of the ink-jet recording device according to the present invention and FIG. 3 is a plan showing a nozzle face in one example of a color recording head used in the second embodiment of the ink-jet recording device according to the present invention. In the drawings, the same reference number is allocated to the same part as that in FIG. 1 and the description is omitted. A reference number 21 denotes a color recording head, 22 denotes nozzles for cyan, 23 denotes nozzles for magenta and 24 denotes nozzles for yellow. In the above first embodiment, the example that the recording head is provided every color is shown. In the second embodiment, one color recording head 21 jets ink in three colors of cyan, magenta and yellow.

The nozzles for cyan 22 for jetting cyan ink, the nozzles for magenta 23 for jetting magenta ink and the nozzles for yellow 24 for jetting yellow ink are arranged in the color recording head 21 as shown in FIG. 3. A recording head for black ink 4 is provided separately and its recording width is constituted so that it is wider than the recording width of any color in the color recording head 21. In this case, the recording head for black ink 4 also uses process black ink obtained by mixing ink in three colors of cyan, magenta and yellow. According to such constitution of the recording heads, the number of recording heads is reduced, the cost can be reduced and for black frequently used, high speed printing is enabled owing to wide recording width.

In the ink-jet recording device provided with the recording heads constituted as described above, as in the above first embodiment, ink exhausted from each recording head by sucking from each recording head by a pump 7, false jetting in each recording head and others is also collected and mixed in a maintenance part 5. Sucking operation and false jetting operation in maintenance are executed every recording head, however, as ink in each color of cyan, magenta and yellow is jetted by one recording head particularly in this constitution, the quantity of sucked ink is approximately equal. Ink exhausted into a cap 6 from the color recording head 21 by sucking and false jetting is already mixed in the cap 6 to be process black ink.

The mixed process black ink is filled into the black ink tank of the recording head for black ink 4 through a black ink filling path 11. Hereby, ink discarded heretofore can be utilized again, the running cost and labor required for replacing recording heads or ink tanks can be reduced. As no waste ink is produced, an ink absorber for waste ink is not required and the recording device can be miniaturized.

Figure 4:
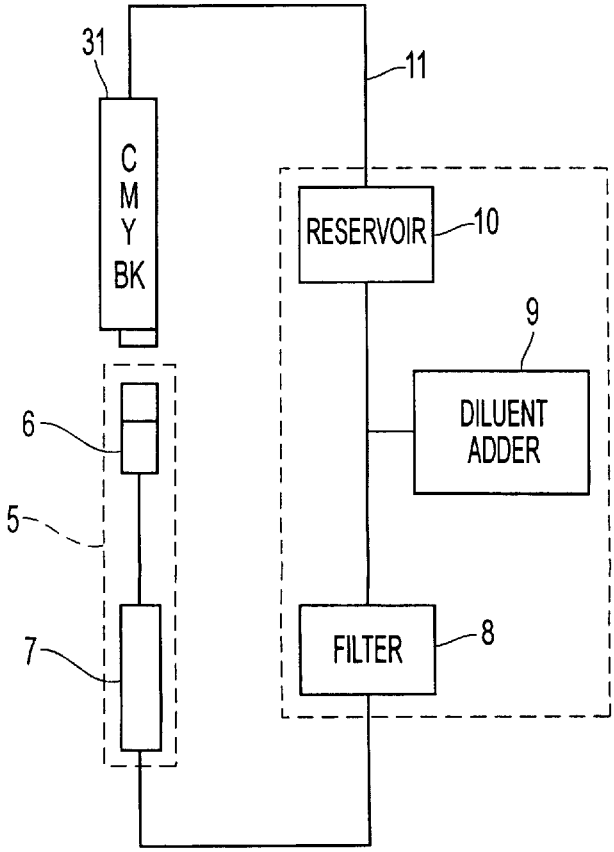
FIG. 4 is a schematic main block diagram showing a third embodiment of the ink-jet recording device according to the present invention.
Figure 5:
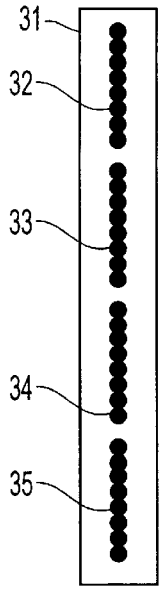
FIG. 5 is a plan showing a nozzle face in one example of a recording head used in the third embodiment of the ink-jet recording device according to the present invention.

FIG. 4 is a schematic main block diagram showing a third embodiment of the ink-jet recording device according to the present invention and FIG. 5 is a plan showing a nozzle face in one example of a recording head used in the third embodiment of the ink-jet recording device according to the present invention. In the drawings, the same reference number is allocated to the same part as that in FIG. 1 and the description is omitted. A reference number 31 denotes a recording head, 32 denotes nozzles for cyan, 33 denotes nozzles for magenta, 34 denotes nozzles for yellow and 35 denotes nozzles for black. This embodiment shows constitution that nozzles for jetting ink in each color are arranged in one recording head 31.

The nozzles for cyan 32 for jetting cyan ink, the nozzles for magenta 33 for jetting magenta ink, the nozzles for yellow 34 for jetting yellow ink and the nozzles for black 35 for jetting process black ink obtained by mixing ink in three colors of cyan, magenta and yellow are arranged in the recording head 31 as shown in FIG. 5. According to this constitution, one recording head has only to be provided.

In the ink-jet recording device provided with the recording head constituted as described above, as in the above first and second embodiments, process black ink which is exhausted and mixed in a cap 6 from the recording head 31 by sucking from the recording head 31 by the pump 7 and false jetting and others in the recording head 31 in the maintenance part 5 is also collected and filled into the black ink tank of the recording head for black ink 4 through a black ink filling path 11.

Hereby, ink discarded heretofore can be utilized again, the running cost and labor required for replacing recording heads or ink tanks can be reduced. As no waste ink is produced, an ink absorber for waste ink is not required and the recording device can be miniaturized.

In the above embodiments, constitution that each recording head is integrated with the ink tank is described, however, the present invention can be similarly applied to constitution that a recording head and an ink tank are constituted so that they can be separated and ink tanks can be replaced. In constitution that an ink tank is separately provided, constitution such as that in a fourth embodiment described next is also enabled.

Figure 6:
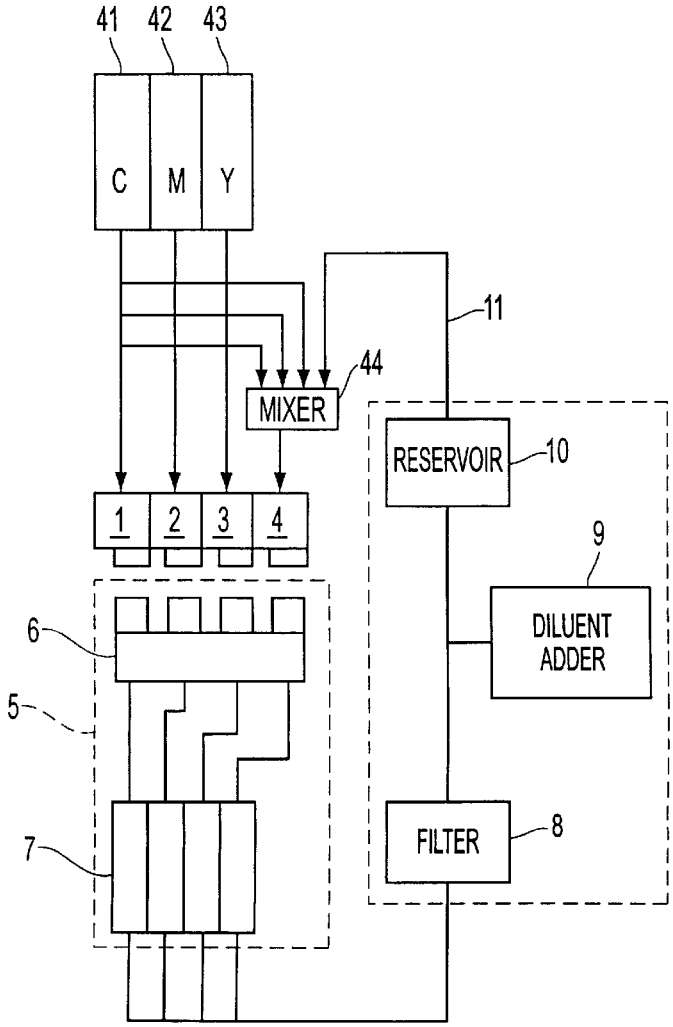
FIG. 6 is a schematic main block diagram showing a fourth embodiment of the ink-jet recording device according to the present invention.

FIG. 6 is a schematic main block diagram showing a fourth embodiment of the ink-jet recording device according to the present invention. In FIG. 6, the same reference number is allocated to the same part as that in FIG. 1 and the description is omitted. A reference number 41 denotes an ink tank for cyan, 42 denotes an ink tank for magenta, 43 denotes an ink tank for yellow and 44 denotes a mixer. Cyan ink is stored in the ink tank for cyan 41, magenta ink is stored in the ink tank for magenta 42 and yellow ink is stored in the ink tank for yellow 43. In this constitution, an ink tank for black is not provided.

A recording head for cyan ink 1, a recording head for magenta ink 2 and a recording head for yellow ink 3 respectively receive ink in each color supplied from the ink tank for cyan 41, the ink tank for magenta 42 and the ink tank for yellow 43 and respectively jet ink in each color according to image information.

The mixer 44 mixes ink in three colors of cyan, magenta and yellow respectively supplied from the ink tank from cyan 41, the ink tank 42 for magenta 42 and the ink tank for yellow 43, processes process black ink and supplies it to the recording head for black ink 4. If process black ink is supplied through a black ink filling path 11, the process black ink supplied again is supplied to the recording head for black ink 4 first or is mixed with ink processed based upon ink in each color and supplied to the recording head for black ink 4. The recording head for black ink 4 jets process black ink supplied from the mixer 4 according to image information.

In such constitution, as in the above first to third embodiments, ink discarded heretofore can be also utilized again, the running cost and labor required for replacing recording heads or ink tanks can be reduced. As no waste ink is produced, an ink absorber for waste ink is not required and the recording device can be miniaturized. Further, as a black ink tank is not required to be provided, the recording device can be miniaturized by the quantity. For a user who frequently uses black ink, ink in other colors is hardly consumed, the efficiency of utilization is low and in some case, the degeneration of ink because of long-term storage and others are feared. However, according to the above constitution, as both a user who frequently uses black ink and a user who frequently uses color ink can consume ink equally, the efficiency of the utilization of ink can be enhanced.

FIG. 6 shows the constitution that an ink tank for black is not required based upon the constitution in the first embodiment shown in FIG. 1, however, constitution that an ink tank for black is not used may be also similarly adopted for the constitution of the recording heads in the second and third embodiments respectively shown in FIGS. 2 and 4.

As clear from the above description, according to the present invention, as process black ink obtained by mixing ink in each color of cyan, magenta and yellow is used for black ink, ink in each color of cyan, magenta and yellow sucked in maintenance operation for example can be utilized again for black ink. Hereby, the running cost and labor required for replacing recording heads or ink tanks can be reduced.

Also, no waste ink is produced by using ink in each color sucked in maintenance operation as described above for black ink and an ink absorber required for absorbing waste ink heretofore can be removed from the body of the recording device. Hereby, there is effect that the miniaturization and the reduction of the cost of the recording device are enabled.

FIG. 1
8. FILTER
9. DILUENT ADDER
10. RESERVOIR
FIG. 2
8. FILTER
9. DILUENT ADDER
10. RESERVOIR
FIG. 4
8. FILTER
9. DILUENT ADDER
10. RESERVOIR
FIG. 6
8. FILTER
9. DILUENT ADDER
10. RESERVOIR
44. MIXER

What is claimed is:

1. An ink-jet recording device, comprising:

a first nozzle for jetting a first color ink onto a recording medium;

a second nozzle for jetting a second color ink onto said recording medium;

a third nozzle for jetting a third color ink onto said recording medium;

a fourth nozzle for jetting a black ink onto said recording medium; and a black ink supplying means for supplying the black ink into the fourth nozzle, wherein the black ink is made by mixing the first through the third color inks to be supplied by said black ink supplying means.

2. The ink-jet recording device according to claim 1, wherein:

the first through third color inks are selected from the group consisting of cyan, magenta, and yellow; and the black ink is made by mixing the first through the third inks by the same amount.

3. An ink-jet recording device, comprising:

a first nozzle for jetting a first color ink onto a recording medium;

a second nozzle for jetting a second color ink onto said recording medium;

a third nozzle for jetting a third color ink onto said recording medium;

a fourth nozzle for jetting a black ink onto said recording medium;

a suction means for sucking the inks from said first through fourth nozzles; and a mixing device for mixing the sucked inks by said suction means and for supplying the mixed ink as black ink to said fourth nozzle.

4. The ink-jet recording device according to claim 3, further comprising:

a filter for removing impurities from the sucked ink.

5. The ink-jet recording device according to claim 3, further comprising:

a diluent adding means for adding diluent to adjust the viscosity of black ink made by said maintenance device.

6. The ink-jet recording device according to claim 3, wherein the first through third color inks are selected from the group consisting of cyan, magenta, and yellow; and the black ink is made by mixing the first through the third inks by the same amount.

* * * * *